United States Patent [19]

Sougawa

[11] Patent Number: 4,852,686

[45] Date of Patent: Aug. 1, 1989

[54] SILENCER FOR OUTBOARD ENGINE

[75] Inventor: Masafumi Sougawa, Hamamatsu, Japan

[73] Assignee: Sanshin Kogyo Kabushiki Kaisha, Hamamatsu, Japan

[21] Appl. No.: 71,618

[22] Filed: Jul. 9, 1987

[30] Foreign Application Priority Data

Jul. 10, 1986 [JP] Japan ..... 61-162429

[51] Int. Cl.[4] ..... F02M 35/12

[52] U.S. Cl. ..... 181/229; 181/255

[58] Field of Search ..... 181/229, 214, 243, 247, 181/255, 269

[56] References Cited

U.S. PATENT DOCUMENTS

| | | | |
|---|---|---|---|
| 2,801,705 | 8/1957 | Brixius et al. | 181/229 |
| 4,136,756 | 1/1979 | Kawamura | 181/229 |
| 4,448,280 | 5/1984 | Endo | 181/229 |
| 4,620,607 | 11/1986 | Breckenfeld et al. | 181/229 |

*Primary Examiner*—B. R. Fuller

*Attorney, Agent, or Firm*—Ernest A. Beutler

[57] ABSTRACT

An improved molded air inlet device such as an air silencer for an outboard motor that provides a very effective atmospheric air inlet area and which can be easily molded without restricting the flow into the device.

4 Claims, 2 Drawing Sheets

Fig-3
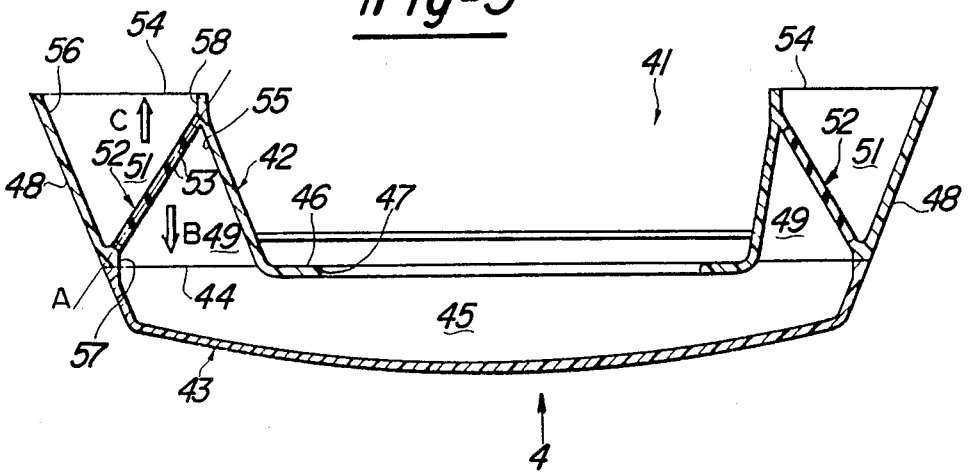
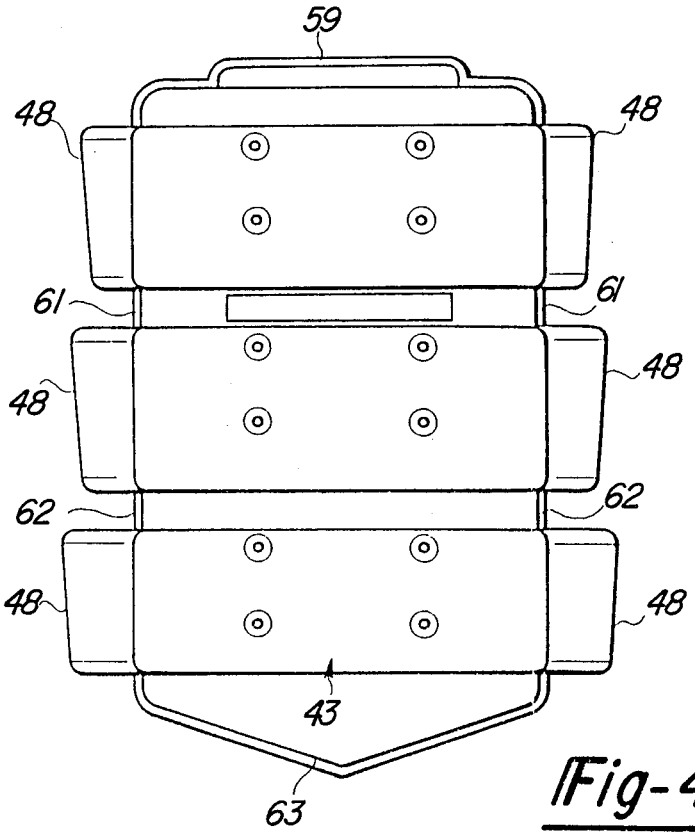
Fig-4

SILENCER FOR OUTBOARD ENGINE

BACKGROUND OF THE INVENTION

This invention relates to a silencer for an outboard engine and more particularly to an improved air inlet device for a machine and a method for forming such an air inlet device.

Many forms of machines induct air and it is a common practice to employ some form of air silencer device for directing atmospheric air to the machine and for silencing the inducted air. Although these purposes are generally straight forward and clear, the spacial limitations frequently make it difficult to form a low cost yet highly effective silencer for such applications. The problems attendant with the designing of such a silencer may be best understood by reference to FIG. 1 which is a top plan view of a power head, indicated generally by the reference numeral 11, of an outboard motor. The power head 11 includes an internal combustion engine, indicated generally by the reference numeral 12 that is contained within a surrounding protective cowling, shown in phantom, and identified by the reference numeral 13. In the illustrated example, the engine 12 is of the V type and has angularly disposed cylinder banks 14 in which pistons 15 reciprocate. The pistons 15 are connected by means of connecting rods 16 to a crankshaft 17 that rotates about a generally vertically disposed axis. Because of the application of the engine 12 to an outboard motor, the crankshaft normally rotates about such a vertical axis.

The engine 12 is of the two cycle, crankcase compression type and for that reason is provided with one or more carburetors 18 that deliver a fuel/air mixture to the individual sealed crankcase chambers of the engine 12. An air inlet silencing device 19 is affixed to the carburetors 18 and draws air from within the protection cowling 13 for delivery to the carburetors 18. As may be readily seen from FIG. 1, the configuration of the engine and its protective cowling 13 dictates a relatively small size for the air inlet silencing device 19.

Referring now additionally to FIG. 2, a conventional form of air inlet silencing device 19 is shown in horizonal cross-section. The air inlet device 19 is normally made up of two parts 21 and 22 which may be conveniently formed from a molded plastic with the parts being formed in a permanent mold. The parts 21 and 22 are affixed to each other along a common face 23 as by bonding, welding or the like.

The air inlet device 19 defines an internal plenum chamber 24 to which air is admitted by means of pairs of rearwardly facing diverging air inlets 25. The air inlets 25 terminate in atmospheric air inlet openings 26 that are defined by perforated walls formed in the body portion 21. It should be readily apparent that the effective area of the inlet openings 26 should be substantially large so as to provide adequate air flow to the carburetors 18 and engine 12. Previously proposed constructions have, however, provided relatively restricted air inlet openings 26 for the reason now to be described.

As has been noted, the air inlet device portions 21 and 22 are normally formed from a plastic by a molding process. This is normally done in a permanent mold that is comprised of two parts and which parts move together and away from each other. In their closed position, they define a cavity into which fluid material is introduced so as to fill this cavity and form the body of the resultant part 21 or 22.

Turning specifically to the formation of the part 21, the two mold parts have mating faces that meet along a plane A and which move in their opened and closed directions in the perpendicular directions B and C. As such, the inlet channels 25 are formed with a configuration wherein the inner walls thereof must accommodate this perpendicular movement. As a result, the outer wall surfaces of the part 21 are relatively thick, as at 27, so as to provide a straight surface 28 that will accommodate the mold movement along the direction B. As a result, the inlet channels 25 rather than being of a uniform cross-sectional configuration have a reduced area at their inlet end that will restrict flow into the plenum chamber 24.

It is, therefore, a principal object of this invention to provide an air inlet device for a machine that will not restrict inlet flow and yet which can be conveniently formed in a permanent mold.

It is a further object of this invention to provide an air inlet device for an engine or the like which will permit adequate air flow and which can be easily formed in a permanent mold.

It is another object of this invention to provide an air inlet device for a machine in which the flow inlet area is substantially unrestricted but nevertheless compact.

SUMMARY OF THE INVENTION

A first feature of this invention is adapted to be embodied in an air inlet device for a machine that inducts atmospheric air through an inlet opening. The device is comprised of an outer housing that defines a plenum chamber, an outlet from said outer housing for communicating said plenum chamber with the machine inlet opening and at least one inlet passage to the plenum chamber that extends at an angle to the plane of the outlet and which has an effecting cross-sectional area that does not decrease from its inlet end to the end that discharges into the plenum chamber.

Another feature of this invention is adapted to be embodied in an air inlet device for a machine that inducts air and which is formed in a mold having first and second mold parts that move relative to each other in directions perpendicular to a plane from a closed position wherein a mold cavity is formed into which fluid material may be cast and solidified and an opened position in which the solidified device may be removed. The inlet device is formed with at atmospheric air inlet that extends generally at an angle to the plane and which also extends generally at an angle to the perpendicular direction. The air inlet has a triangular cross-sectional shape in a plane perpendicular to the plane and parallel to the perpendicular direction of mold movement with the base of the triangle lying on the plane or on a plane perpendicular to the plane.

BRIEF DESCRIPTION OF THE DRAWINGS

FIG. 3 is a cross-sectional view, in part similar to FIG. 2, showing an air inlet device constructed in accordance with an embodiment of the invention.

FIG. 4 is a front elevational view looking generally in the direction of the arrow 4 in FIG. 3 showing the air inlet device.

DETAILED DESCRIPTION OF THE PREFERRED EMBODIMENT

Figure 1:
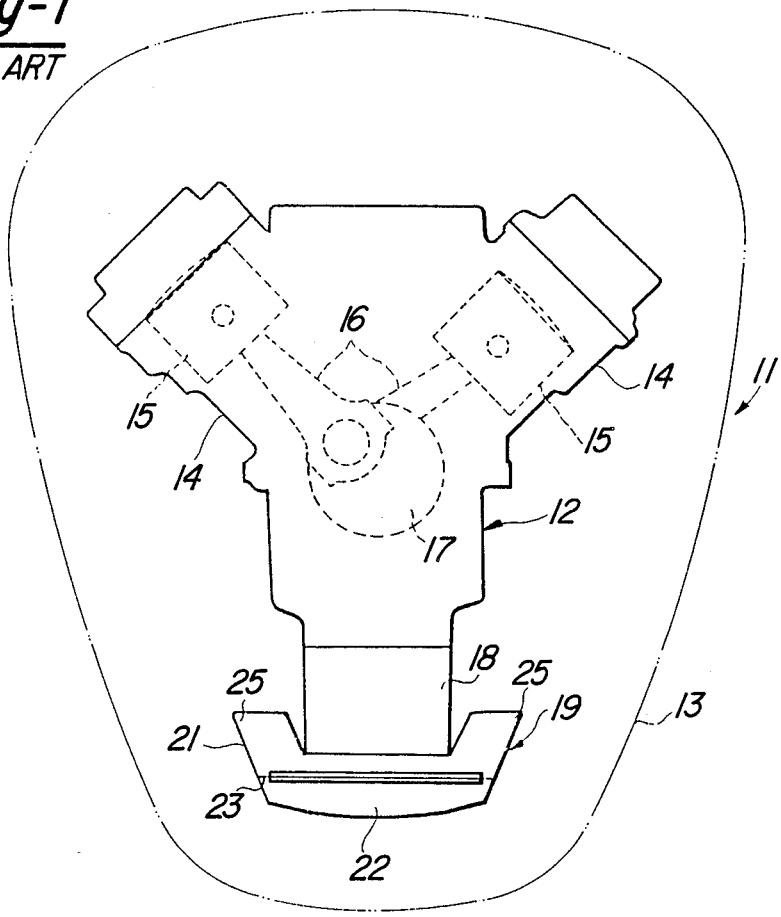
Fig-1 PRIOR ART
FIG. 1 is a top plan view of the power head of an outboard motor as showing an exemplary environment for the invention and also an exemplary prior art type of arrangement.
Figure 2:
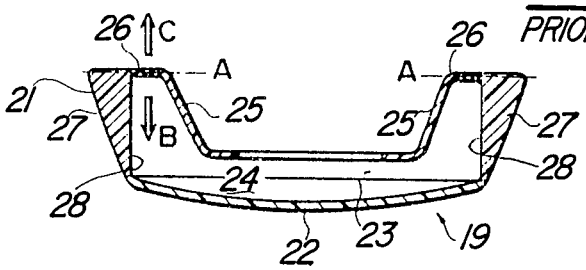
Fig-2 PRIOR ART
FIG. 2 is a cross-sectional view taken on a plane perpendicular to the plane of FIG. 1 and shows a prior art type of air silencer.

Referring now in detail to FIGS. 3 and 4, an air inlet silencer device for an outboard engine constructed in accordance with an embodiment of the invention is identified generally by the reference numeral 41. The air inlet device 41 is adapted to be employed in an environment as shown in FIG. 1 in conjunction with an internal combustion engine 12 of a power head 11 of an outboard motor. It is to be understood, however, that certain facets of the invention may be utilized in conjunction with other applications. The air silencer 41, like prior art type of air silencers, is formed of an assembled construction made up of molded first and second pieces 42 and 43, respectively. These pieces 42 and 43 are connected to each other around an interface 44 as by frequency resistance welding. Such form of welding is preferred for this type of arrangement since it does not result in a seam or the like and eliminates flashing at the joint.

Body portions 42 and 43, when mated together, form a plenum chamber 45 that extends generally vertically. This plenum chamber 45 is defined in part by a rear wall 46 that is formed from the body portion 42 and in which outlet openings 47 are formed. These outlet openings 47 register with the inlets to the carburetors 18 and, in the illustrated embodiment, the engine 12 is of the V6 type and, hence, there are three carburetors and three outlet openings 47. Any suitable structure can be incorporated for affixing the device 41 to the carburetors 18 with the outlet openings 47 in registry with the air inlets to the carburetors 18.

A plurality of air inlet portions 48 are provided and are defined primarily solely by the housing portion 42. These air inlet portions 48 admit atmosphereic air from the area within the outboard motor protective cowling 13 to the plenum chamber 45. The openings 48 extend generally at an angle to a plane defined by the interface 44 and diverge outwardly as seen clearly in FIG. 3. In the illustrated embodiment, there are provided four such inlet openings 48.

The inlet openings 48 are defned by a pair of generally triangular sections 49 and 51 that have a common side which is defined by a screen or filter portion 52 having elliptical openings 53 for passing air. This screen 52 is disposed at an angle indicated by the plane A to the mating faces 44.

The base of the triangle 49 lies on the plane defined by the interface 44 while the base of the triangle 51 lies upon an opening 54 that extends parallel to the plane defined by the interface 44 and which forms the inlet opening for the air inlets 48. It should be noted that the remaining side of the triangle 49 is defined by a surface 55 that is inclined at an angle so that a mold half may move in the direction B away from a mating mold half and define the triaangular configuration 49 with free movement. In a similar manner, the remaining side 56 of the triangular portion 51 is disposed at an angle so that a similar mold occurrence may move in the direction of the arrow C. It should be noted that there are relatively short straight sections 57 and 58 so that the triangular shapes 49 and 51 are slightly modified from a pure triangle but nevertheless they provide an air flow path that does not diminish in cross-sectional area from the inlet opening 54 to the area where the plenum chamber 45 is served.

From the aforedescribed configuration, it should be readily apparent that the disadvantages of the prior art type of constructions are not found with this construction. In addition, a very simple and highly effective molding technique may be employed to form the air inlet device 41.

There is also provided a flange formed by the portions 59, 61, 62 and 63 that extend around the remaining periphery of the air inlet device so as to provide a neat appearance and a good configuration.

It should be readily apparent from the foregoing description that the described construction provides a very effective and useful air inlet device that can be conveniently molded, presents a good appearance and which will provide adequate flow of inlet air. Although an embodiment of the invention has been illustrated and described, various changes and modifications may be made without departing from the spirit and scope of the invention, as defined by the appended claims.

I claim:

1. An air inlet device for a machine that inducts atmospheric air through an inlet opening, said device being comprised of an outer housing defining a plenum chamber, an outlet from said outer housing lying in a plane at one side of said plenum chamber and communicating said plenum chamber with the machine inlet opening, a pair of inlet passageways to said plenum chamber extending at opposing angles divergently from the plane of said outlet and each having effective cross-sectional areas that do not decrease from an inlet end of the respective inlet passageways to a point where the respective inlet passageways communicate with the plenum chamber.

2. An air inlet device as set forth in claim 1 wherein the inlet device is formed from a molded plastic.

3. An air inlet device as set forth in claim 2 wherein the molded plastic is comprised of two pieces and the inlet passageways are formed completely in one of the pieces.

4. An air inlet device as set forth in claim 1 wherein each inlet passageway has a screen extending diagonally across the inlet passageway to divide the inlet passageway into two sections having triangular shapes in cross-section with the screen forming a common side of the triangular shapes.

* * * * *